US007144602B2

(12) United States Patent
Bengtsson et al.

(10) Patent No.: US 7,144,602 B2
(45) Date of Patent: Dec. 5, 2006

(54) PROCESS FOR OBTAINING A FLEXIBLE/ADAPTIVE THERMAL BARRIER

(75) Inventors: Per Bengtsson, Paris (FR); Laurent Paul Dudon, Viry Chatillon (FR)

(73) Assignee: Snecma Moteurs, Paris (FR)

( * ) Notice: Subject to any disclaimer, the term of this patent is extended or adjusted under 35 U.S.C. 154(b) by 0 days.

(21) Appl. No.: 10/846,520

(22) Filed: May 17, 2004

(65) Prior Publication Data

US 2005/0025898 A1 Feb. 3, 2005

Related U.S. Application Data

(63) Continuation-in-part of application No. 10/825,324, filed on Apr. 16, 2004, now abandoned.

(30) Foreign Application Priority Data

Apr. 25, 2003 (FR) ..... 03 05086

(51) Int. Cl.
*C23C 4/10* (2006.01)

(52) U.S. Cl. ..... 427/454; 427/453

(58) Field of Classification Search ..... 427/454
See application file for complete search history.

(56) References Cited

U.S. PATENT DOCUMENTS 5,897,921 A * 4/1999 Borom et al. ..... 427/454
6,102,656 A * 8/2000 Nissley et al. ..... 415/174.4

FOREIGN PATENT DOCUMENTS

EP 0765951 4/1997
EP 0897020 2/1999
EP 1 295 964 A2 * 3/2003

* cited by examiner

*Primary Examiner*—Katherine Bareford
(74) *Attorney, Agent, or Firm*—Oblon, Spivak, McClelland, Maier & Neustadt, P.C.

(57) ABSTRACT

The invention proposes a process for obtaining a flexible/adaptive thermal barrier, the thermal barrier comprising a ceramic layer deposited on a substrate covered with a sublayer, the ceramic layer being deposited by thermal spraying using a torch. The ceramic layer is deposited in a single pass and the torch is set to give the ceramic layer a thickness of at least 80 μm.

7 Claims, 2 Drawing Sheets

PROCESS FOR OBTAINING A FLEXIBLE/ADAPTIVE THERMAL BARRIER

This application is a continuation-in-part of application Ser. No. 10/825,324, filed Apr. 16, 2004, now abandoned, the contents of which are herein incorporated by reference in its entirety.

TECHNICAL FIELD OF THE INVENTION

The invention relates to flexible/adaptive thermal barriers, that is to say to thermal barriers having sufficient flexibility to adapt to the deformations of the substrate, whether they be of mechanical origin or of dilatometric origin owing to a thermal gradient. The invention relates more particularly to an economic process for obtaining such barriers by thermal spraying.

STATE OF THE ART AND PROBLEM POSED

At the present time, turbomachine components exposed to the hot combustion gas flux are made of superalloys resistant to high temperatures and protected from heat and corrosion by a coating called a thermal barrier. Presently, a thermal barrier usually consists of:

an aluminous sublayer of NiPtAl or MCrAlY (where M=Fe, Ni, Co or NiCo) forming a chemical obstacle to oxidation and to corrosion;

a thermally insulating $ZrO_2$-YO ceramic layer.

In what follows and for convenience of language, the term "vertical" will be used for the direction approximately perpendicular to the surface of the component to which the thermal barrier is applied.

Likewise, the term "horizontal" will be used for the directions approximately tangential to the surface of the component to which the thermal barrier is applied.

The ceramic layer is conventionally deposited in several passes by thermal spraying, for example using a plasma arc torch. At each pass, an elementary ceramic layer with a thickness of usually between 5 μm and 40 μm is deposited, the number of elementary layers thus applied defining the total thickness of the coating. This procedure makes it possible:

- to control the thickness of the coating better;
- to reduce the heating of the thermal barrier and thus prevent the coating from cracking and spalling as it cools down.

However, this process has two drawbacks:

- the ceramic layer has little flexibility in the directions tangential to the surface of the component. Consequently, the thermal barriers thus obtained are poorly resistant to large thermal shocks, for example within turbine blades, these thermal barriers spalling and becoming detached quite rapidly;
- the vertical bonds between the elementary layers are imperfect as they are provided by microwelds that form when the molten ceramic droplets arrive on the previously deposited and partially cooled ceramic. Consequently, the elementary ceramic layers constituting such thermal barriers tend to separate under the effect of thermal shocks, which also causes spalling of the thermal barrier.

The thermal barriers thus obtained by plasma spraying are therefore reserved for stationary components not undergoing thermal shocks, such as combustion chambers. The ceramic layer has a thickness of around 0.3 mm and in this case its lifetime is perfectly well controlled.

To provide turbojet combustion chambers with better heat protection, thick plasma-sprayed thermal barriers, that is to say with a thickness of greater than 1 mm, have been developed. For this application, it is necessary to introduce vertical cracks in the thickness of the ceramic coating so as to make the coating flexible in the horizontal directions, that is to say tangential to the surface of the component. Without this network of unidirectional cracks, the thermal stresses at the border of the coating would be too high, and this would result in the thermal barrier spalling during its operation.

In this regard, U.S. Pat. No. 5,073,433 teaches that the ceramic layer is deposited by thermal spraying in several successive passes, each pass depositing a layer of material of around 5 μm, each pass being followed by a cooling step so as to form vertical cracks. However, such a process has two drawbacks:

- the coating carried out in several passes separated by a cooling step involves an additional cost;
- this process has the usual drawback of the multilayer coatings described above, namely imperfect bonds by microwelds between the elementary layers, favoring separation of these elementary layers and spalling of the thermal barrier. This drawback is aggravated by the coating being cooled between each elementary layer.

Also known, from U.S. Pat. No. 6,305,517, is a process for applying a thermal barrier in thin layers by plasma spraying, the bond between the layers being improved by columnar germination of the grains, which may thus become common to several layer. Unfortunately, with such a process the germination also takes place laterally, thereby reducing the flexibility of the thermal barrier.

A process called "vapor deposition", more particularly EB-PVD (Electron Beam Physical Vapor Deposition), is known at the present time. The ceramic layer obtained is in the form of fine adjacent vertical columns linked via their base to the sublayer. As an indication, these columns have a diameter of around 5 μm. Such a process gives thermal barriers of excellent quality with good horizontal flexibility and good vertical bonds that are consequently very resistant to thermal shocks. However, such a process has two drawbacks:

- it is slow and expensive;
- the thermal barrier despite everything still has a limited lifetime, since the hot corrosive combustion gases reach the sublayer via the small but very numerous spaces between the columns, the progressive corrosion of the sublayer causing the spalling and destruction of the thermal barrier.

More generally, it should be noted that the spalling sensitivity of a thermal barrier increases in the projecting parts of the component that have a small radius of curvature, and therefore more particularly in small components such as turbine blades.

Moreover, to have a thermal barrier with the lowest possible spalling sensitivity, it is necessary to try to obtain a thermal barrier exhibiting high material cohesion and stronger bonding.

A first problem to be solved is to improve the spalling resistance of the thermal barriers.

A second problem to be solved is to reduce the cost of producing a thermal barrier.

SUMMARY OF THE INVENTION

In order to be resistant both to high thermal stresses on the surface of the substrate and to high mechanical stresses of the latter, and consequently to solve the first problem posed, a thermal barrier must be flexible in the directions tangential to the surface that it covers. For this purpose, it is necessary to introduce vertical cracks going from the surface of the thermal barrier down to the substance or to the sublayer, that is to say passing right through the ceramic layer.

The invention proposes a process for obtaining a flexible/adaptive thermal barrier, the thermal barrier comprising a ceramic layer with a thickness of at least 80 μm, deposited on a substrate covered with a sublayer, the ceramic layer being deposited by thermal spraying using a "plasma arc" torch, the operation of the torch being defined by the power of the torch, the material flow rate, the distance from the torch to the component to be coated and the speed of movement of the torch relative to the component. Such a process is noteworthy in that it consists in depositing, directly on the sublayer and in just a single pass, the ceramic layer while maintaining a spraying distance of between 20 mm and 90 mm, the speed of movement of the torch being between 2 mm/s and 10 mm/s, the material flow rate being between 40 g/mn and 100 g/mn and the arc current of the torch being between 500 A and 800 A, so as to obtain, after cooling, at least two approximately vertical cracks per millimeter that pass right through the ceramic layer.

It will be understood that since the power of the torch is set to a high value and the ceramic layer is produced in a single pass, the new drops of molten material arrive on material that is still very hot, thereby causing excellent bonding by welding between the ceramic grains in the vertical direction. This is favored by choosing the speed of movement of the torch to be as low as possible, preferably between 2 mm/s and 10 mm/s. Thus, the temperature at the point of deposition is high, thereby making it possible to obtain a dense microstructure with few horizontal microcracks, delaminations and pores, and better cohesion of the material. Spraying in a single pass is a key parameter that has a direct impact on the spalling resistance of the thermal barrier. This is because if material is sprayed in several passes, the cohesion between the various layers of material deposited at each pass is lower than within the same layer. A horizontal crack can then be initiated between two layers, this being prejudicial to the integrity of thermal barrier. Moreover, since the ceramic layer thus formed beneath the jet is very hot, when the jet is moved the cooling of the layer upon contact with the ambient air causes a large vertical thermal gradient, this gradient promoting the formation of cracks at the surface of the ceramic layer, these cracks then propagating vertically down to the sublayer, thus passing through the entire ceramic layer.

The inventors have found that these two phenomena occur simultaneously. With too low a power, the cracks are spaced apart and very irregular, while the vertical bonds between the grains of material are poor. By increasing the power of the torch, the cracks are denser and homogenous and the vertical bonds between the grains are simultaneously improved. With sufficient power, that is to say high enough to obtain a crack density at least equal to the claimed value, the inventors obtain a thermal barrier having a satisfactory spalling resistance up to a ceramic layer thickness of 250 μm, the optimum quality being, however, between 100 μm and 150 μm. It should be noted that the power of the torch appropriate for obtaining this result depends on many parameters such as the ceramic used, the thermal dissipation in the component, the powder flow rate, the width of the jet, the loss factor of the torch, etc.

It should also be noted that a person skilled in the art will, however, limit the power of the torch in order not to cause excessive heating with a risk of causing the substrate to melt or its granular structure being unacceptably degraded. The dimensions of the cracks, and also the number of cracks per mm, depend on the thickness of the coating. The thicker the coating, the broader the cracks and the lower the number of them per mm.

The thickness of the ceramic layer obtained in a single pass obviously depends on the material flow rate, on the distance of the torch from the component and on the speed of movement of the torch, that is to say of the jet, relative to the component, and also on the loss factor of the torch. Thus, the thickness of the ceramic layer increases with the material flow rate, but this thickness decreases when the distance or the speed increase. A person skilled in the art will define these parameters experimentally on a case by case basis according to the equipment at his disposal.

The invention also relates to the application of the present process to a turbojet blade having an airfoil and a root, the ceramic layer being applied to the airfoil. Such a process is noteworthy in that it consists in:

a. holding the root of the blade in place by a tool that can rotate at a rotation speed V about its geometrical axis;

b. exposing the airfoil to the jet of a torch capable of relative movement D1 parallel to the geometrical axis and relative movement D2 perpendicular to the geometrical axis; and c. spraying ceramic in a single movement of the jet from one of the ends of the airfoil to its other end, the blade being rotated about the geometrical axis, the torch being moved along D2 in order to remain at a constant distance from the surface of the airfoil, the torch being moved along D1 in order to form, on the surface of the airfoil, a spiraled ceramic layer with a pitch equal to the width of the jet.

DESCRIPTION OF THE FIGURES

The invention will be better understood and the advantages that it affords will become more clearly apparent in view of a detailed example of implementation of the process and of the appended figures.

DETAILED DESCRIPTION

Figure 1:
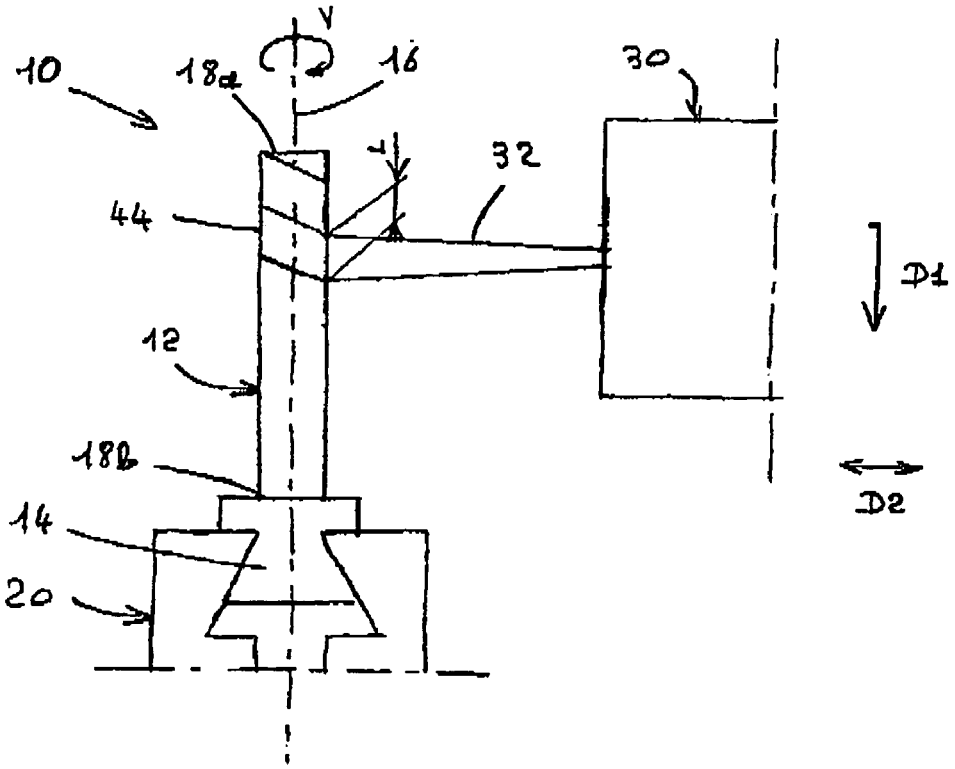
FIG. 1 illustrates the deposition of the ceramic layer with a plasma torch.

Reference will firstly be made to FIG. 1.

The component to be coated with a thermal barrier is a turbine blade 10 made of a nickel-based superalloy with directional solidification. The thermal barrier comprises an MCrAlY sublayer covered with a 125 μm ceramic layer made of zirconia $ZrO_2$ with 8% yttria $Y_2O_3$.

The airfoil 12 of the blade 10 is covered with an MCrAlY sublayer deposited using the standard processes.

The blade 10 is then held by its root 14 on a rotary assembly 20 capable of making the blade rotate about its axis 16, that is to say about itself, in the length direction, the airfoil 12 being presented in front of a plasma torch 30, the jet of which is denoted by 32. The plasma torch 32 here is the F4 model sold by the company whose registered name is Sultzer Metco.

The torch is placed at 50 mm from the blade 10, the blade 10 then being rotated about its axis 16. The torch 30 is turned on and the jet 32 firstly touches the tip 18*a* of the blade 10 and moves progressively toward the root 14 in order to reach the other end 18*b* of the airfoil 12 and thus form, on the surface of the blade 10, a ceramic layer 44 having the shape of a helix with touching turns. The jet 32 moves over the surface of the airfoil 12 with a resultant speed of 6 mm/s. The powder flow rate is 70 g/mn and the power of the torch is obtained with an arc current of 700 A. The setting of the torch is what is called "hot"—the coating temperature is 550° C.—this temperature being measured on the surface of the coating just after passage of the jet 32 and at 10 mm to the rear of the jet.

Figure 2:
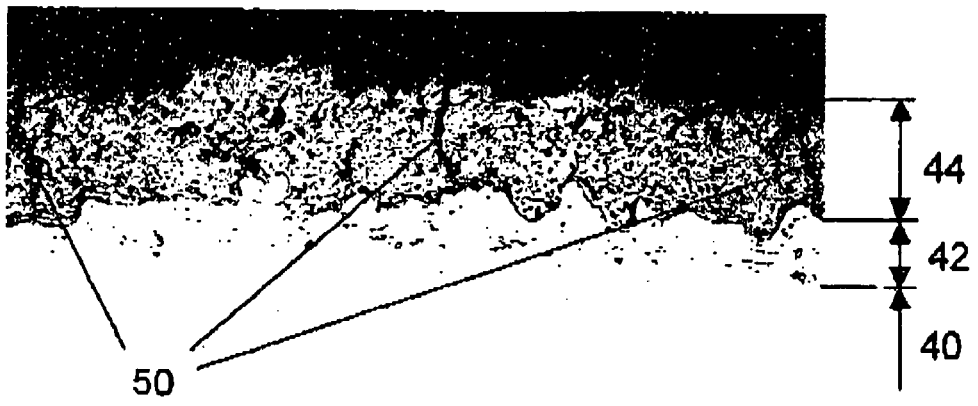
FIG. 2 is a micrograph of the thermal barrier thus obtained in cross section.

Reference will now be made to FIG. 2, in which the numbers 40, 42 and 44 refer to the substrate, the sublayer and the ceramic layer thus obtained, respectively. The cracks are referenced 50. In this micrograph, there are 4.8 cracks per millimeter, the mean distance between the cracks being 200 μm. As the micrograph shows, the cracks 50 are approximately vertical, that is to say approximately perpendicular to the substrate 40. The two ends of the cracks 50 may be parallel or may open out toward the surface or toward the sublayer 42. The key characteristic of the cracks 50 is that they propagate from the surface toward the sublayer 42, passing right through the thickness of the ceramic layer 44, as illustrated in the micrograph.

Figure 3:
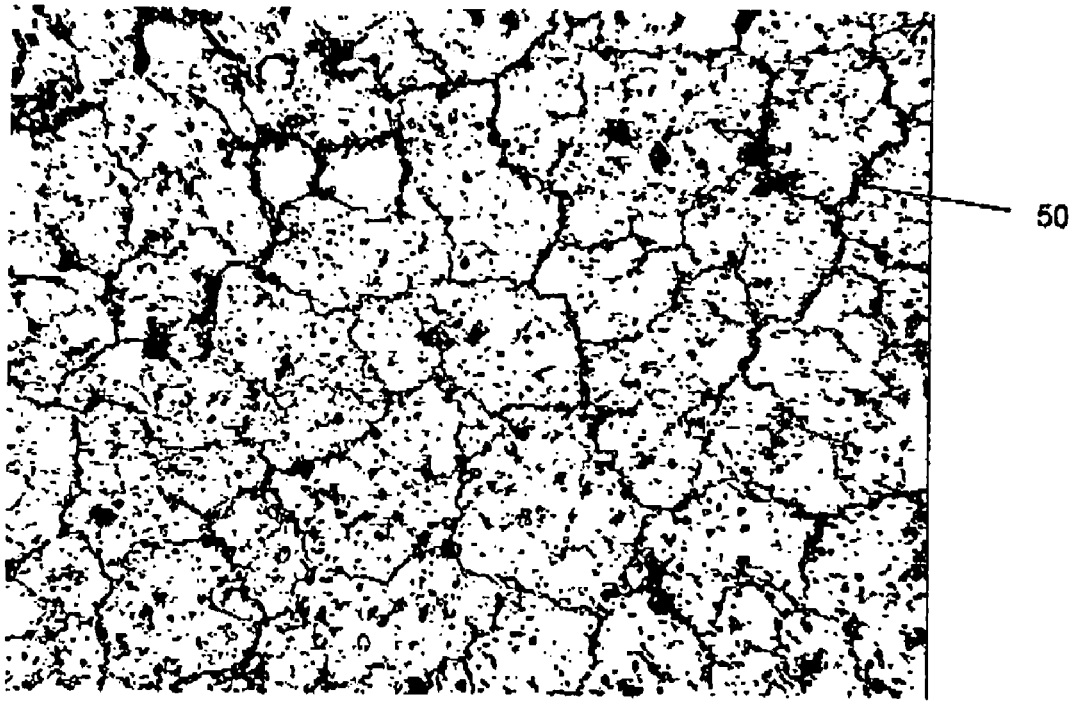
FIG. 3 is a micrograph of the surface of the thermal barrier.

Reference will now be made to FIG. 3. This micrograph shows that the cracks 50 form a locally irregular but statistically homogeneous and anisotropic network, these cracks 50 providing the thermal barrier with the required flexibility in a plane tangential to the substrate 40. The crack density is defined as the mean number of cracks per millimeter cutting any geometrical straight line.

The invention claimed is:

1. A process for obtaining a flexible/adaptive thermal barrier, the thermal barrier comprising a ceramic layer with a thickness of at least 80 μm, deposited on a substrate covered with a sublayer, the ceramic layer being deposited by thermal spraying using a plasma arc torch, an operation of the torch being defined by a power of the torch, a material flow rate, a spraying distance from the torch to a component to be coated and a speed of movement of the torch relative to the component, the process comprising: depositing, directly on the sublayer and in just a single pass, the ceramic layer while maintaining the spraying distance between 20 mm and 90 mm, the speed of movement of the torch between 2 mm/s and 10 min/s, the material flow rate between 40 g/min and 100 g/min and an arc current of the torch between 500 A and 800 A, so as to obtain, after cooling, at least two approximately vertical cracks per millimeter that pass right through the ceramic layer.

2. The process as claimed in claim 1, the component being a blade with a geometrical axis, comprising an airfoil and a root, the ceramic layer being applied to the airfoil, the process comprising:

holding the root of the blade in place by a tool that can rotate at a rotation speed V about the geometrical axis;

exposing the airfoil to a jet of the torch capable of relative movement D1 parallel to the geometrical axis and relative movement D2 perpendicular to the geometrical axis; and spraying ceramic in a single movement of the jet from one end of the airfoil to the other, the blade being rotated about the geometrical axis, the torch being moved along D2 in order to remain at a constant distance from a surface of the airfoil, the torch being moved along D1 in order to form, on the surface of the airfoil, a spiraled ceramic layer with a pitch equal to a width of the jet.

3. The process as claimed in claim 1, wherein a temperature at a point of deposition is maintained high and combination of the high temperature and the speed of the movement of the torch assure a dense microstructure with minimum horizontal microcracks, delaminations, and pores and with improved cohesion of the deposited material.

4. The process as claimed in claim 1, wherein the sublayer comprises MCrAlY, where M is a material selected from the group consisting of Fe, Ni, Co, and NiCo.

5. The process as claimed in claim 1, wherein the thickness is less than 250 μm.

6. The process as claimed in claim 1, wherein the thickness is between 100 and 150 μm.

7. The process as claimed in claim 1, wherein dimensions of the vertical cracks depend on the thickness of the ceramic layer, the thicker the ceramic layer, the broader the cracks, and the lower the number of cracks per millimeter.

* * * * *